United States Patent [19]

Morse

[11] 3,990,861

[45] Nov. 9, 1976

[54] STRONG, HIGH PURITY NICKEL

[75] Inventor: Jeremy Painter Morse, Chesapeake, Ohio

[73] Assignee: Huntington Alloys, Inc., Huntington, W. Va.

[22] Filed: Jan. 20, 1975

[21] Appl. No.: 542,606

Related U.S. Application Data

[60] Division of Ser. No. 342,034, March 16, 1973, Pat. No. 3,895,942, which is a continuation-in-part of Ser. No. 157,004, June 25, 1971, abandoned.

[52] U.S. Cl. ..... 29/182.5; 75/170; 75/211; 148/126

[51] Int. Cl.[2] ..... B22F 3/00

[58] Field of Search ..... 75/170, 211; 29/182, 29/182.5; 148/126

[56] References Cited

UNITED STATES PATENTS

| | | | |
|---|---|---|---|
| 3,382,051 | 5/1968 | Barnett | 29/182.5 |
| 3,533,760 | 10/1970 | Weizenbach et al. | 29/182.5 |
| 3,533,781 | 10/1970 | Tracey et al. | 75/206 |

OTHER PUBLICATIONS

Rosenberg, *Nickel and its Alloys*, 1968 NBS 106 Dept. of Comm. p. 48.

*Primary Examiner*—Brooks H. Hunt
*Attorney, Agent, or Firm*—Miriam W. Leff; Ewan C. MacQueen

[57] ABSTRACT

A nickel powder metallurgy product containing very small amounts of carbon, oxygen, magnesium, and aluminum is characterized by very high strength and fine grain.

8 Claims, No Drawings

STRONG, HIGH PURITY NICKEL

This is a division, of application Serial No. 342,034, filed March 16, 1973, now Pat. No. 3,895,942, which is a continuation-in-part of U.S. application Ser. No. 157,004, filed June 25, 1971 now abandoned.

The present invention relates to a method for producing dispersion strengthened nickel by powder metallurgy and to the product resulting therefrom.

Wrought commercially pure nickel is desirable in many applications due to the high toughness, ductility, corrosion resistance and weldability of nickel. Thus, typical applications include food processing equipment, chemical handling equipment, electrical and electronic parts, aerospace and missile components, caustic handling equipment and piping, rocket motor cases, transducers, etc. Nickel compositions of high purity are characterized by shortcomings including, for example in the case of flat products such as sheet or strip, the formation of Luders lines or bands, which are surface irregularities attributable to localized yielding upon flexing. Also, nickel compositions are susceptible to undesirable grain growth upon heating to high temperatures, and for many applications, are regarded as having insufficient strength.

Conventional nickel products of high purity can be produced by melting and casting or can be produced by powder metallurgy. Nickel products are amenable to production by powder metallurgy since carbonyl nickel powder of high purity is readily available. Some of the shortcomings of commercially available high purity nickel products could apparently be solved by, for example, alloying magnesium in small amounts in nickel so as to increase the strength and refine the grain of the resulting product. However, it is found that magnesium in excess of 0.10% produces detrimental porosity in welds. Inclusion of a fine dispersoid such as alumina in nickel produced by the powder metallurgy would also seem to provide a means for increasing the strength and for refining the grain of the product. However, it is found that inclusion of an amount of fine alumina on the order of about one volume percent in nickel produced by powder metallurgy still results in room temperature and high temperature tensile strengths which are insufficient. Furthermore, even as low an amount as ½ volume percent of alumina dispersed in nickel is found to impair high temperature ductility. In fact, even as little as ⅛ volume percent of alumina in nickel impairs weldability due to porosity. Accordingly, the potential strengthening effect of alumina in nickel produced by powder metallurgy cannot, as a practical matter, be realized.

It is an object of the present invention to provide, by powder metallurgy, a nickel product of high purity characterized by improved strength at room temperature and at elevated temperatures, by resistance to grain coarsening upon heating to high temperatures, and which is weldable.

A further object of the invention is to provide a high purity nickel product which in the form of sheet or strip does not exhibit Luders lines or bands.

Generally speaking, the process to which the present invention is directed comprises mixing a highly pure, fine nickel powder, e.g. a highly pure carbonyl nickel having an average particle size of about 7 microns or less, about 0.01% to about 0.06% by weight of fine alumina powder having a particle size not exceeding about 0.10 microns, e.g. about 0.01 to about 0.03 microns, about 0.07% to about 0.1% fine magnesium powder, up to about 0.15% or 0.20% carbon, compacting the mixture, e.g. hydrostatic pressing, sintering the compact in a protective atmosphere such as dry hydrogen at a temperature in excess of the boiling point of magnesium, and preferably at a temperature of at least 1175° C., and then hot working the resulting sintered product by conventional means. As an alternative, the pressing operation may be eliminated. In this method, the blended mixture is poured into a mold coated so as to prevent sticking of the powders at high temperatures. The mold is then secured by sand seal against the ingress of combustion gases from the sintering furnace. The sintering atmosphere, e.g. dry hydrogen, is admitted to the mold via a gas inlet pipe, and escapes through the sand seal of the mold. The mold assembly is then placed in the sintering furnace, and sintering proceeds as described below.

Carbonyl nickel powder being an average particle size of about 4 to 7 microns is satisfactory for use in the process. Fine alumina having a particle size of about 0.03 microns is also satisfactory. Desirably the carbon is introduced into the mixture as a fine powder, e.g. minus 325 mesh, preferably carbon powder coated with nickel as, for example, by the carbonyl technique.

Magnesium must be included in a form such that it can reduce the alumina. Preferably, the magnesium is introduced as elemental magnesium powder. Possibly a powdered alloy of magnesium can be used; however, the reaction rate will be slower, and higher temperatures may be required to vaporize the magnesium.

The blended mixture may be compacted at pressures up to, for example, about 30,000 pounds per square inch so as to form a self-sustaining compact or billet having a theoretical density of at least 65%, e.g. an apparent density of about 5.8 gm/cc. The billet may then be sintered in flowing hydrogen, cracked ammonia, or other reducing atmosphere containing at least 10%, and preferably at least 30% hydrogen having a dew point not higher than minus 60° F.

In the consolidated product resulting from the aforementioned processing procedure, it appears that the refractory oxide content thereof is present in finer particulate form than that of the initial alumina introduced into the mix. On the basis of presently available analytical techniques, it appears that alumina is converted aluminum and magnesium is converted to magnesia.

In a preferred embodiment of this invention, the relative levels of magnesium and alumina used in preparing the alloys are such that at least sufficient magnesium is present, stoichiometrically, to reduce all of the alumina present to metallic aluminum. It appears that in such embodiment, substantially no alumina in particulate form is present in the nickel product, instead, available techniques indicate that the bulk of the aluminum (i.e. greater than 90%) added initially as alumina powder is present in the nickel product as aluminum metal dissolved in the nickel matrix. When sufficient magnesium is employed in the initial mixture a portion thereof appears, by the best techniques available, to be present as magnesium metal dissolved in the nickel matrix, while a portion thereof appears to be present as finely divided magnesia, and that such magnesia dispersoid has a particle size of less than about 0.1 micron.

Satisfactory products in accordance with the invention contain up to about 0.20% carbon, about 0.004% to about 0.04% aluminum, about 0.7% to about 0.10% magnesium, with the balance apart from oxygen essentially nickel. Trace impurities may, of course, be present. Oxygen in the product is present substantially in the form of magnesia. The concentration of the magnesia dispersoid is about 0.1% to about 0.25% by volume. It can be pointed out that the amount of magnesium present as metal can be determined by heating a thin sheet or strip about 0.005 inch thick in an oxidizing atmosphere comprising hydrogen saturated at room temperature with water vapor to a temperature of about 1092° C. for 20 hours so as to cause migration of metallic magnesium to the surface of the metal by diffusion, where it becomes oxidized. Such magnesium oxide can be removed by pickling and when the metal of the remaining body is analyzed for magnesium this magnesium can be taken as that present in the oxide form, since such magnesium cannot diffuse. Generally, about 40% to about 70%, e.g., about 50%, of the magnesium will be present in metallic form.

In one embodiment of this invention the alloy contains about 0.10% to about 0.20% carbon. Such alloys, in addition to being weldable, are characterized by particularly improved strength at room temperatures. In another embodiment, the alloys of this invention are essentially free of carbon, and such alloys, in addition to being weldable and having improved strength over pure nickel, are characterized by having good electrical conductivity.

The sintered mass or billet produced in accordance with the invention can be extruded or hot rolled to plate, bar or tube shell and can be converted to the usual mill forms such as plate, sheet, strip, rod, wire, tubing, etc. Because of the relatively high sintering temperature, sintered billets produced in accordance with the invention will have an apparent density of at least about 95%.

For the purpose of giving those skilled in the art a better understanding of the invention, the following illustrative examples are given:

EXAMPLE I

A 10 kg. mixture consisting essentially of, by weight, about 0.08% elemental magnesium powder (minus 325 mesh); 0.012% alumina powder having an average particle size of 0.03 microns; 0.16% carbon in the form of minus 325 mesh nickel-coated carbon powder particles containing 25% carbon; and the balance 4 to 7 micron particle size carbonyl nickel powder having carbon, iron, and oxygen contents of about, respectively, 0.054, 0.003, and 0.062%, was mechanically blended in an 8 quart capacity twin shell blender for a period of about 20 minutes. Thereafter, the blended powder charge was hydrostatically pressed at 30,000 psi into a billet approximately 4 inch diameter and 9 inches long. The billet was sintered in hydrogen at about 1200° C. for about 8 hours. Half of the sintered billet was hot finished, i.e. hot-forged at about 1175° C., from a 4 inch diameter to a ¾ inch square bar, which bar was then reheated to 1175° C. and forged to a ¾ inch diameter rod.

The remaining half of the 4 inch diameter billet was hot forged to a 3/8 inch thick by 2 inch strip, which was subsequently heated and hot-rolled at about 1175° C. to 0.187 inch thick strip. This strip was annealed at 980° C. for one hour and cold rolled to 0.056 inch thick strip. Both the ¾ inch diameter rod and the 0.056 inch thick strip were annealed, respectively, at 980° C. for ½ hour and 1025° C. for 3 minutes and tested with the results set forth in the following Tables I through V.

TABLE I

| HOT-FINISHED AND ANNEALED ROD Room Temperature Properties | | | | |
|---|---|---|---|---|
| Alloy | Tensile Strength (ksi) | Yield Strength (0.2% offset) ksi | Elongation % | Reduction of Area % |
| 1 | 85 | 29 | 43.5 | 58 |
| A | 65 | 22.5 | 47.5 | — |

TABLE II

| Cold-Rolled* + Annealed Strip Room Temperature Properties | | | | |
|---|---|---|---|---|
| Alloy | Tensile Strength (ksi) | Yield Strength (0.2% offset) ksi | Elongation % | Reduction of Area % |
| 1 | 86 | 31 | 44 | — |
| A | 65 | 22.5 | 47.5 | — |

*cold-rolled subsequent to hot working

TABLE III

| GRAIN SIZE OF STRIP VERSUS ANNEALING CONDITON* | | | | | |
|---|---|---|---|---|---|
| Annealing Condition | 1023° C./3 min. | 1150° C./3 min. | 1150° C./1 hr. | 1023° C./3 min. + 1150° C./1 hr. | 1023° C./3 min. + 1150° C./24 hrs. |
| Alloy 1 | No. 8.5 | No. 8.5 | No. 8.5 | No. 8.5 | No. 8.5 |
| Alloy A | No. 6.5 | No. 3 | No. 0 | No. 0-00 | — |

*all material cold-worked at least 50% prior to annealing and grain size given in ASTM number equivalents.

TABLE IV

| HOT FINISHED + ANNEALED ROD 1200° F. PROPERTIES | | | | |
|---|---|---|---|---|
| Alloy | Tensile Strength (ksi) | Yield Strength (0.2% offset) ksi | Elongation % | Reduction of Area % |
| 1 | 26.0 | 19.3 | 23.5 | 28.0 |
| A | 21.5 | 10.0 | 76.0 | — |
| | | 1600° F. PROPERTIES | | |
| 1 | 11.6 | 10.0 | 23.0 | 21.3 |
| A | 8.2 | 3.6 | 110.0 | — |

TABLE V

| COLD-ROLLED* AND ANNEALED SHEET 1200° F. PROPERTIES | | | | |
|---|---|---|---|---|
| Alloy | Tensile Strength (ksi) | Yield Strength (0.2% offset)ksi | Elongation % | Reduction of Area % |
| 1 | 23.9 | 11.8 | 38.5 | — |
| A | 21.0 | 5.9 | 68.0 | — |

*cold-rolled subsequent to hot working

The results of the room temperature tests performed on the above-mentioned annealed rod and annealed strip of the dispersion-strengthened nickel alloy, designated as Alloy 1, are compared in Tables I and II with nominal values for commercial wrought nickel alloy rod and sheet in an annealed condition, containing, by weight, 0.08% carbon, 0.18% manganese, 0.2% iron, 0.18% silicon and designated as Alloy A in the Tables. Data given are for material produced by melting and casting. This comparison indicates the dispersion-strengthened nickel alloy (Alloy 1) to be superior to the wrought nickel (Alloy A). Specifically, the room temperature tensile and yield strengths of the sheet and rod of the present invention are at least 25% higher than those for Alloy A, and the elongation characteristics of both compositions are generally comparable.

From the measured grain sizes (Table III) of respective strips of Alloy A and the measured grain size of Alloy 1 of the present invention, all after cold working at least 50% and the various annealing treatments shown in Table III, it can be seen that the wrought nickel product (Alloy A) exhibits significant grain growth with increasing annealing time and/or annealing temperature, whereas the grain size of the strip provided in accordance with the present invention appears to remain constant over the range of annealing conditions investigated. This factor, and the fine grain size found, is of advantage in providing flat sheet for deep drawing and other applications. The high temperature test results (Tables IV and V) for the abovementioned bars and strips provided in accordance with the invention (Alloy 1) and the nominal high temperature values for wrought nickel bars and strips (Alloy A) show that, for annealed condition, the power metallurgy product of the invention provides significant improvements in tensile strength and yield strength over the commercial wrought nickel products at both 1200° F. and 1600° F., the yield strength of the present product being about 2 to 3 times as great as that for the wrought nickel product, and the elongation being retained substantially at the higher temperatures. The sintered product contains 0.14% carbon, 0.08% magnesium, 0.006% aluminum, and the balance, apart from oxygen, nickel. Activity data shows that roughly 50% of the magnesium remains as elemental magnesium in the product.

EXAMPLE II

A second mixture having the same constituents and correlated proportions as the 10 kg. mixture above and weighing about 1637 kg. was mechanically blended in a 20 cubic foot capacity twin shell blender for one hour, after which all of the blended powder was hydrostatically pressed to a billet about 12 inches in diameter and 120 inches long. The billet was sintered in hydrogen at 1200° C. for 9 hours. The sintered billet was then hot rolled at about 1150° C. to a slab about 7 inches thick and about 13.5 inches wide. The slab was reheated to 1150° C. and hot rolled to a hot band ¼ inch thick and 29 inches wide. The hot band was annealed at about 980° C. for about 6 minutes at temperature, pickled in nitric acid-hydrofluoric acid solution, and cold rolled to a 0.110 inch thick strip. The 0.110 inch thick strip was belt ground and then cold-rolled further to produce a 0.056 inch thick strip. The strip was then continuously bright annealed at 980° F. for 3 minutes in a hydrogen atmosphere. The analysis of the sintered product of Example II was substantially the same as that reported under Example I.

There was no visible evidence of Luders banding on the surface of the cold worked and annealed strip of the present invention that has produced in accordance with the procedure described in the Examples. Strip produced in accordance with the Examples was welded readily by the TIG process to produce sound, crack-free welds.

EXAMPLE III

Two 10 kg. mixtures were prepared. One consisted essentially of, by weight, about 0.08% elemental magnesium powder (−325 mesh); 0.012% alumina powder having an average particle size of 0.03 microns, 0.16% carbon in the form of −325 mesh nickel-coated carbon powder particles containing 25% carbon, and the balance 4 to 7 micron particle size carbonyl nickel powder having carbon, iron and oxygen content of about, respectively, 0.054%, 0.003%, and 0.062%. The second mixture was identical in all respects except that no carbon powder was added. Both of the mixtures were mechanically blended in an 8-quart capacity twin-shell blender for a period of about 20 minutes, and subsequently pressed, sintered, hot worked and annealed in a manner identical to that described in Example I. The powder containing carbon is similar to the alloy prepared in Example I, and is referred to herein as Alloy 1a. The second alloy, which is essentially carbon-free, is referred to as Alloy 2.

In the following Tables VI to XI, the properties of these two compositions are compared with nominal values for either commercial products, viz. a commercial wrought nickel product and/or a commercial pure nickel product. Alloy A, as described in Example I, refers to a commercial wrought nickel alloy rod and sheet in an annealed condition, containing, by weight, 0.08% carbon, 0.18% manganese, 0.2% iron, 0.18% silicon. Pure nickel is a highly pure commercial nickel having a nominal nickel content of 99.97% and containing typically less than about 0.02%, by weight, carbon.

TABLE VI

HOT-FINISHED AND ANNEALED ROD
Room Temperature Properties

| Alloy | Tensile Strength (ksi) | Yield Strength (0.2% offset)ksi | Elongation % | Reduction of Area % |
|---|---|---|---|---|
| 1a | 79.2 | 25.5 | 45 | 65.6 |
| 2 | 57.1 | 21.3 | 55 | 83.9 |
| Pure Ni* | 50 | 16 | 50 | — |

*Pure Nickel properties for Hot finished samples - which have not been annealed

TABLE VII

COLD ROLLED, ANNEALED STRIP
ROOM TEMPERATURE PROPERTIES

| Alloy | Tensile Strength (ksi) | Yield Strength (0.2% offset)ksi | Elongation % |
|---|---|---|---|
| 1a | 83.2 | 27.8 | 44.5 |
| 2 | 60.2 | 17.6 | 44.7 |
| Pure Ni | 50 | 16 | 50 |

TABLE VIII

GRAIN SIZE OF STRIP*
ANNEALED 1023° C./3 min.

| Alloy | ASTM GRAIN SIZE |
|---|---|
| 1 | 8.5 |
| 1a | 8.0 |
| 2 | 8.0 |
| A | 6.5 |

TABLE VIII-continued

| GRAIN SIZE OF STRIP* ANNEALED 1023° C./3 min. | |
|---|---|
| Alloy | ASTM GRAIN SIZE |
| Pure Nickel | 7.0** |

*All material cold worked at least 50% prior to annealing.
**annealed at 760° C./3 min.

TABLE IX

| HOT FINISHED AND ANNEALED ROD 1200° F. PROPERTIES | | | | |
|---|---|---|---|---|
| Alloy | Tensile Strength (ksi) | Yield Strength (0.2% offset)ksi | Elongation % | Reduction of Area % |
| 1a | 29.3 | 16.3 | 31.0 | 37.0 |
| 2 | 24.6 | 10.1 | 44.0 | 41.9 |
| 1600° F. PROPERTIES | | | | |
| 1a | 10.6 | 8.1 | 38 | 33.2 |
| 2 | 10.8 | 8.3 | 24 | 20.3 |

TABLE X

| COLD ROLLED, ANNEALED STRIP 1200° F. PROPERTIES | | | | |
|---|---|---|---|---|
| Alloy | Tensile Strength (ksi) | Yield Strength (0.2% offset)ksi | Elongation % | Reduction of Area % |
| 1a | 26.3 | 11.6 | 39.5 | — |
| 2 | 23.4 | 8.9 | 41.5 | — |

TABLE XI

| ROOM TEMPERATURE ELECTRICAL RESISTIVITY* | |
|---|---|
| Alloy | Resistivity ($\mu\Omega$-cm) |
| 1a | 10.3 |
| 2 | 7.3 |
| A | 9.47 |
| Pure Nickel | 7.48 |

*Reliability of values is ±6%.

Comparison of the results tabulated in the Tables show that Alloy 2, an alloy of the present invention containing essentially no carbon, has improved strength at room temperature over the commercial pure nickel (Tables VI and VII) and has comparably good electrical properties (Table XI). Moreover, the grain size control effect of the dispersoid applies to the alloy free of carbon, i.e. Alloy 2, as well as the carbon-containing alloys, i.e. Alloys 1 and 1a. (Table VIII). With regard to the grain size, it will be noted that the pure nickel recrystallizes at a lower temperature than the alloys and was therefore annealed at a lower temperature. However, even at the lower annealing temperature, the pure nickel has a coarser grain size. With regard to the properties at higher temperatures, it is believed that similar advantages in strength at elevated temperatures are present in the alloys of this invention with respect to pure nickel.

Analyses of Alloys 1a and 2 show: Alloy 1a contains 0.13% carbon, 0.076% magnesium, and 0.007% aluminum. Alloy 2 contains less than 0.01% carbon 0.073% magnesium, and 0.007% aluminum. The balance in each alloy, apart from oxygen, is essentially nickel. The magnesium activity of Alloy 1a is 60.5% and that of Alloy 2 is 64.5%.

EXAMPLE IV

In an alloy of this invention prepared as described in Example I (Alloy 1) various analytical procedures were followed to determine the nature of the dispersoid. It was determined by X-ray residue analysis from a 10% bromine in methanol solution that the sample was free of $Al_2O_3$, and it was determined by X-ray residue analysis from a 10% phosphoric acid in water solution that nickel oxide was not present. The alloy was also analyzed by electron microscopy and electron diffraction. From these analytical procedures the dispersoid was identified as magnesium oxide. It is believed, upon study of the results, that the alloy is dispersed with two types of magnesium oxide. One type is round, uniformly distributed, and about 0.01 micron. The second type is in the form of rather large crystallites of MgO, randomly distributed. Scanning electron microscopic examination of the dispersoid strengthened products at a definition of about 5 microns indicates that magnesium-rich areas are distributed throughout the product. The technique applied also demonstrated that no coalescence of dispersoid particles had taken place as a result of processing in accordance with the invention. Further evidence indicating extremely fine subdivision of the dispersoid particles in the final nickel products is taken from the fact that high strength properties are obtained in accordance with the invention, particularly in view of the small amounts of alloying material included in the nickel product. Additionally, the microstructure of the nickel product is remarkably clean when viewed optically at magnifications up to 200 diameters.

EXAMPLE V

Samples of Alloys 1a and 2 of Example III were analyzed further to determine the nature of the dispersoid and the extent of conversion of alumina and magnesium charged to the initial mixture. The results given below were obtained using Atomic Absorption Spectrophotometry since it is believed to be the most accurate technique available for this purpose. The analytical procedure used involves separation of the product into two components, the first being a solution which will contain elemental Mg, MgO, and elemental Al, and the second a residue which will contain aluminum other than elemental Al (e.g. $Al_2O_3$ and $MgAl_2O_4$), and any magnesium other than that present as elemental Mg and MgO (e.g. $MgAl_2O_4$).

With respect to the aluminum content, it was determined by the above procedure that about 0.0001% of Alloy 1a and about 0.0002% of Alloy 2 remains as an oxide, e.g. as $Al_2O_3$ or $MgAl_2O_4$. That is, in Alloy 2 roughly 97% of the aluminum initially charged as $Al_2O_3$ is converted to elemental aluminum. Accordingly, only about 3% of the aluminum added as $Al_2O_3$ in the original blend remains as oxide in the final product.

With respect to magnesium, activity determinations showed that more than 50% of the initial magnesium is converted to oxide. Further analysis by the Atomic Absorption Spectrophotometry procedure described above shows that only about 0.0002% of Alloy 1a and 0.0003% of Alloy 2 is present in a form other than elemental Mg or MgO. (Possibly it is present as $MgAl_2O_4$.) In Alloy 2 this represents less than 1% of the total magnesium oxide. Accordingly, 99% of the oxidized magnesium appears in the form of MgO.

Thus, substantially all of the initial $Al_2O_3$, i.e. over 95% in these alloys, is converted to elemental Al, and the dispersoid is essentially in the form of MgO.

Although the invention has been explained in terms of initial nickel powder mixtures containing added carbon, alumina, and magnesium, other combination of ingredients may be employed to produce the same effect. Thus oxygen may be introduced as a refractory oxide such as $TiO_2$ in place of alumina, provided the requirement is met that the free energy of formation of the oxide of the reducing metal in the sintering temperature range is higher than the free energy of formation of the added refractory material in the sintering temperature range, together with the further requirement that the added reducing metal be in the vapor state at the high sintering temperature employed. It should also be noted that in the embodiment of this invention discussed above, in which magnesium is the reducing agent, other sources of oxygen may be used other than alumina, provided, as indicated above, the oxides are stable up to the temperature at which the magnesium vaporizes and provided that the free energy of formation of magnesia is greater than that of the additive oxide. Thus, it is possible to use an oxide, for example, of nickel, cobalt, iron, copper, manganese, and tungsten in the place of the alumina. Sufficient oxide should be present to oxidize about 10% of the magnesium. It is believed that the principal function of the alumina in the mixture is that it serves as a source of oxygen which source is intimately mixed with and dispersed throughout the initial mixture. The alumina is particularly advantageous because it satisfies the technical requirements, it is readily available in the desired fine particle size, and it is relatively inexpensive.

While the reaction which occurs during the sintering of powder mixtures as contemplated in accordance with the invention is not fully understood, it has been found essential that the sintering be conducted at a temperature exceeding substantially the boiling point of magnesium, and preferably at a sintering temperature of at least 1175° C. It is believed that the magnesium metal content of the nickel powder mixture evaporates at the high sintering temperature and permeates the interstices between the solid nickel particles which form the sintering environment. In this way, opportunity is afforded for magnesium vapor to reduce the alumina particles, so as to convert the alumina to aluminum metal with the production of magnesia. It is to be recognized that oxygen in small amounts may be available in the sintering environment, as from the nickel powder, the atmosphere, etc., and this oxygen can combine as magnesia. It is to be borne in mind in this connection that the free energy of formation of magnesia in the sintering temperature range (e.g. 1175° to about 1400° C.) is higher than is the free energy of formation of alumina in this temperature range. The foregoing explanation seems to fit the experimental data insofar as they can be ascertained. Whatever the mechanism, it is found that where sufficient magnesium is present to reduce the alumina, the final consolidated nickel product is substantially free of alumina, per se, i.e. it contains less than about 10% and preferably less than about 5% of $Al_2O_3$. Available analytical techniques demonstrate that the aluminum present in the final consolidated product is present essentially as the metal and not as an oxide, and also that 50% or more of the magnesium is converted substantially to MgO.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A dispersion-strengthened powder metallurgy nickel product having uniformly dispersed therein about 0.1% to about 0.25%, by volume, of finely divided magnesia, said product consisting essentially of, by weight, up to about 0.2% carbon, about 0.004% to about 0.04% aluminum, about 0.07% to about 0.1% magnesium and the balance, apart from oxygen, essentially nickel, said product being further characterized in that more than about 90% of the aluminum is present in metallic form and dissolved in the nickel matrix.

2. A dispersion-strengthened powder metallurgy nickel product as defined in claim 1 wherein about 40 to about 70% of the magnesium is present in metallic form and at least about 95% of the aluminum is present in metallic form, and magnesium and aluminum being dissolved in the nickel.

3. A dispersion-strengthened powder metallurgy nickel product as defined in claim 1 wherein the magnesia has a particle size of less than about 0.1 micron.

4. A dispersion-strengthened weldable nickel alloy having uniformly dispersed therein 0.1 to about 0.25%, by volume, magnesia and consisting essentially of about 0.13 to about 0.14% carbon, about 0.07 to about 0.08% magnesium of which about 50 to 60% is in metallic form, about 0.006 to about 0.007% aluminum of which more than about 90% is in metallic form, and the balance apart from oxygen, essentially nickel.

5. A dispersion-strengthened weldable nickel alloy having uniformly dispersed therein about 0.1 to about 0.25%, by volume, magnesia and consisting essentially of about 0.07% magnesium of which about 60% is in metallic form, about 0.007% aluminum of which more than about 90% is in metallic form, and the balance, apart from oxygen, essentially nickel.

6. A dispersion-strengthened nickel product produced by a powder metallurgy method comprising:

a. providing a blended powder charge consisting essentially of, by weight, up to about 0.2% carbon, about 0.07% to about 0.1% magnesium; a metal oxide as a source of oxygen, said metal oxide being present in sufficient amount to oxidize at least 10% of the magnesium to magnesia, said metal oxide being stable at the temperature at which the magnesium vaporizes, and said metal oxide having a free energy of formation less than that of the magnesia; and the balance fine nickel powder;

b. sintering the powder misture in a reducing atmosphere at a temperature at least in excess of the boiling point of magnesium in said charge to convert metal in said metal oxide to the elemental state and magnesium to magnesia and to form a sintered billet; and c. thereafter hot working the sintered billet to provide a dispersion-strengthened product.

7. A dispersion-strengthened powder metallurgy nickel product as defined in claim 1 wherein the carbon content is at least about 0.1%.

8. A dispersion-strengthened powder metallurgy nickel product as defined in claim 1 wherein the product is substantially carbon free.

* * * * *